United States Patent [19]

Fenstermaker

[11] 4,328,995

[45] May 11, 1982

[54] PRODUCTION OF LIGNITE FROM UNDERGROUND DEPOSITS

[75] Inventor: Roger W. Fenstermaker, Bartlesville, Okla.

[73] Assignee: Phillips Petroleum Company, Bartlesville, Okla.

[21] Appl. No.: 143,669

[22] Filed: Apr. 25, 1980

[51] Int. Cl.[3] ..... E21C 41/02

[52] U.S. Cl. ..... 299/17; 166/271; 299/18

[58] Field of Search ..... 299/14, 17, 4, 16, 18; 166/269, 271

[56] References Cited

U.S. PATENT DOCUMENTS

| | | | |
|---|---|---|---|
| 2,952,450 | 9/1960 | Purre | 299/4 |
| 3,850,477 | 11/1974 | Aldrich et al. | 299/5 |
| 3,990,513 | 11/1976 | Perch | 299/4 X |
| 4,032,193 | 6/1977 | Drinkard et al. | 299/4 |
| 4,076,078 | 2/1978 | Drinkard et al. | 166/271 |
| 4,080,308 | 3/1978 | Lamont | 252/363.5 |
| 4,092,045 | 5/1978 | Sullivan | 299/18 |

OTHER PUBLICATIONS

Kaiser, Univ. of Texas at Austin, Bureau of Economic Geology Report No. 79-2 pages-1974.

Stephens, Lawrence Livermore Lab., Univ. of Calif. "In-Situ Coal Gasification" Aug. 6, 1975-12 pages.

Borovicka, Translation From Czech "Underground Gasification of Slovak Coal (Lignate)" 5/76 12 pages.

Coal Age "Will Chemicals Replace Crushing" Feb. 1978 pp. 176-179.

*Primary Examiner*—Ernest R. Purser

[57] ABSTRACT

Lignite is removed from a seam or stratum containing the same in an underground formation by forming within the seam or stratum with aid of a production fluid, which can contain a dispersant or surfactant, a suspension of the lignite in said fluid whereupon the fluid is removed to the surface and the lignite recovered therefrom. The fluid thus recovered is re-used. The production fluid can be heated and/or pulsated and is injected and passed through the formation under conditions to promote the formation of the desired lignite suspension.

4 Claims, 1 Drawing Figure

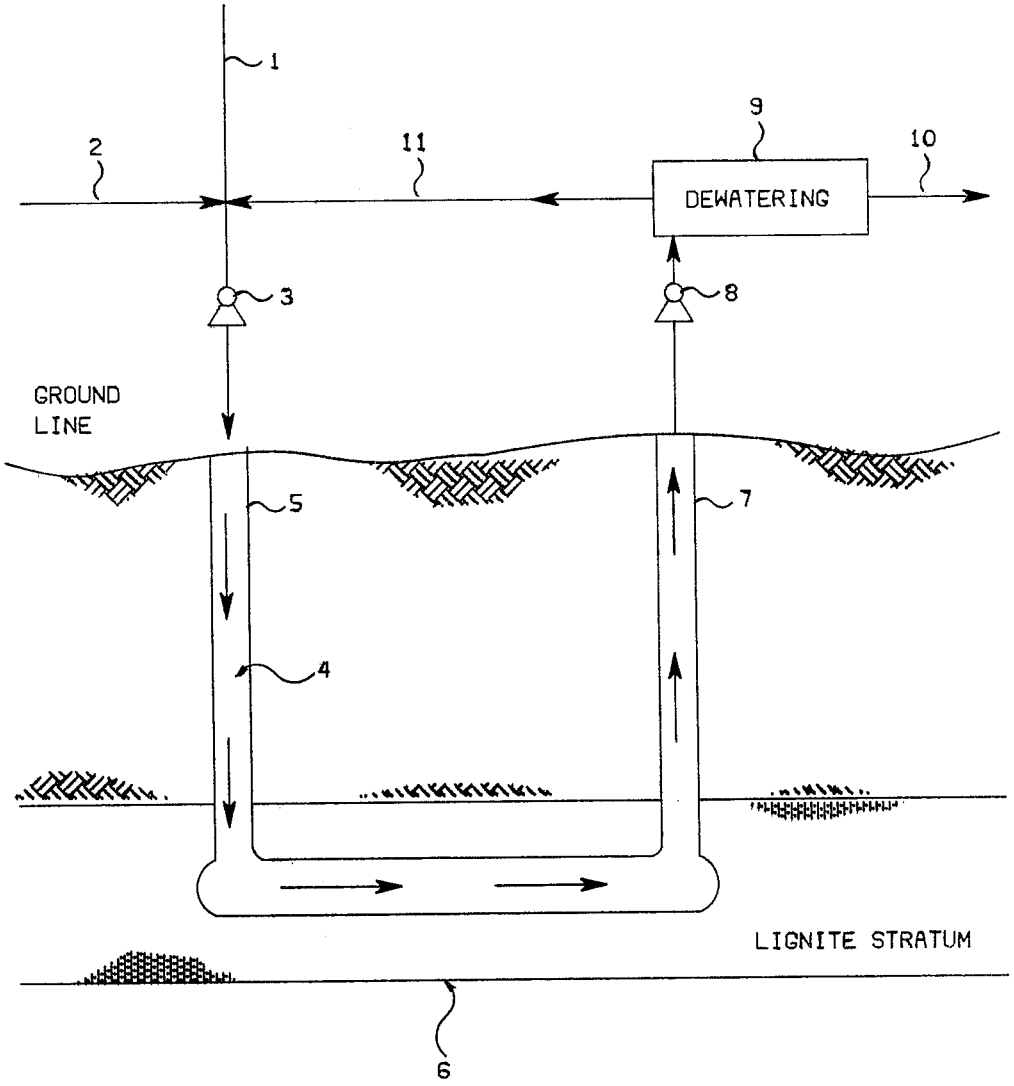
1
2
11
9
10
DEWATERING
3
8
GROUND
LINE
5
7
4
LIGNITE STRATUM
6

PRODUCTION OF LIGNITE FROM UNDERGROUND DEPOSITS

BRIEF SUMMARY OF THE INVENTION

Lignite is produced from underground deposits of the same using injection and producing wells. A carrier fluid, for example, water preferably containing a dispersing agent or surfactant is forced into the formation from an injection well and produced together with carried lignite from a producing well. A water jet at elevated pressure, which can be pulsating, facilitates disruption of the lignite bed. The force of the fluid suspends and carries with it to the producing well, the loosened particles or suspention thereof. The suspended lignite can be pumped from the producing well or produced therefrom under its own flow. At the surface the lignite and producing fluid are separated. The fluid is then re-used.

BRIEF DESCRIPTION OF DRAWING

In the drawing there is shown diagrammatically, an operation according to the invention. The drawing depicts an injection well, a producing well, and a fluid recovery or dewatering zone.

DETAILED DESCRIPTION

This invention relates to the production of lignite from underground deposits containing the same.

In one of its concepts, the invention provides for the removal and consequent production of lignite from an underground deposit containing the same by subjecting the lignite to the action of a fluid injected under pressure and with momentum such that individual or discreet particles of lignite will be formed and suspended therein whereupon a pumpable fluid containing lignite which has been formed is produced from the formation containing the lignite. In another of its concepts, the invention provides a method as herein described wherein an aqueous fluid, preferably containing a dispersant or surfactant, is employed to literally subdivide the lignite formation to produce a pumpable fluid containing lignite whereupon the pumpable fluid is recovered at the surface. In a further concept of the invention, it provides a combination operation in which upon recovery of the pumpable fluid at the surface, the lignite is separated therefrom and the fluid returned to the formation, below ground, to pick up additional lignite. In a further concept, still, the invention provides a process as herein described wherein pressure and velocity and therefore consequent momentum of the injected fluid are so selected as to cause disintegration of the lignite formation to form the pumpable fluid containing the lignite suspended therein. In a still further concept of the invention, it provides the injection and the pulsation of the injected fluid in a manner as to cause vibration or shaking of the lignite in the formation thus to more readily form the desired pumpable fluid which then can be produced.

Lignite is a low-rank, hydrocarbonaceous material having a high moisture, mineral or ash and volatile-matter content, and a heating value of less than about 8300 BTU/lb. (moist, mineral-matter free).

By far the largest and most important use of lignite is in lignite-fuel, steam-electric plants. Ash, a by-product of the combustion, is used as a light weight road aggregate, cement filler, and as an additive in oil-well drilling mud.

There are several kinds of lignite deposits, near surface and deep basin. The former occur at 0 to 200 feet below the surface and are exploitable by modern surface-mining methods; the latter occur at 200 to 5000 feet and are exploitable only by underground mining methods.

One such mining method which is utilized makes use of a machine to break or dig lignite out from a solid seam, load it into a conveyance vehicle, and convey the lignite from the mine. This method is both capital and labor intensive.

The formation of a pumpable product by treatment of raw-mined lignite with a dispersing agent to adjust the viscosity of the lignite which then can be transported and stored is described in U.S. Pat. No. 4,080,308 issued Mar. 21, 1978. U.S. Pat. No. 2,367,665 teaches a method for exploring for subterranean oil deposits by using a dispersing agent to convert a soil sample containing oil into a slurry. Patent 3,850,477 discloses a method for treating unmined coals by injecting a wetting agent to reduce interlayer forces at the natural interfaces of the coal and then injecting an inert gas in order to form a suspension of coal in the gas and recovering the coal.

The disclosures of the reference patents are incorporated herein.

I have now conceived a method by which to continuously produce lignite from an underground formation of it. My method renders considerably more economical the recovery of lignite than to mine it with machines or equipment.

In one form or embodiment of my invention, boreholes or wells are established within a formation containing lignite. There will be at least one borehole or well through which producing fluid will be injected. There will be at least one other borehole or well through which lignite suspended in production fluid will be removed from the ground. The formation or seam containing lignite lieing between an injection well and a production well preferably will be fractured as by a fracturing fluid. The fracturing fluid can be the same or similar to the production fluid. Upon fracturing when more than simply two wells are involved, the boreholes or wells can be re-arranged into a desired number of injection wells and a corresponding desired number, which can be different, of producing wells. In this embodiment the production fluid is aqueous phosphate solution which is injected under conditions sufficient to convert the lignite while still in its underground stratum into a pumpable slurry. A pumpable lignite-containing slurry or fluid is produced through a producing well. At the surface the produced lignite is separated from the aqueous phosphate solution which is returned to and re-used in the formation to produce additional lignite.

It is an object of this invention to produce lignite from an underground formation containing the same. It is another object of this invention to provide an improved method or procedure for producing lignite relatively inexpensively as compared with employment of usual machinery-mining methods. It is another object of the invention to convert lignite in an underground formation or seam into a pumpable fluid or mass.

Other aspects, concepts, objects and the several advantages of the invention are apparent from a study of this disclosure, the drawing, and the appended claims.

Broadly, according to the invention, lignite in an underground formation is converted to a pumpable fluid by the use of a production fluid, which can be water, under pressure and a velocity such that momentum transferred to the lignite in the formation, will cause loosening and suspension into the production fluid, whereupon the production fluid is removed from the formation by way of a production well.

More specifically, according to the invention, the production fluid can be injected under relatively high pressure and velocity such that it will crevice or burrow its way through the formation picking up loosened fragments or particles of lignite so that these can be carried to the surface for recovery and use.

Still further according to the invention, the production fluid can be introduced with pulsations so as to cause a vibration of the lignite within the formation. This will aid in loosening and in the suspension of the lignite.

Further still according to the invention, the production fluid can be any that will produce the lignite according to the invention, and it is now preferred to be water which in a now preferred form of the invention will also contain a dispersant or surfactant. The now preferred dispersant is a phosphate as described herein.

Still further according to the invention, the injected production fluid may have been preheated. When preheated the heat can be generated from combustion of already produced lignite. Thus, there is produced in the field, relatively cheaply, the heat needed for the production of the lignite. Energy requirements for the operation of pumps and other incidental equipment, can be produced from the lignite by known methods.

Underground formations which are applicable to the process of the present invention and which are now preferred are those containing significant amounts of lignite in a concentration and in a total quantity to be economically practical. There are many such lignite deposits throughout the world as well as in the United States. Any lignite deposit which is suitable for underground mining by conventional shaft methods can be mined with attendant economic advantages by the method of the present invention.

The drilling of the boreholes into the lignite seam is carried out by any suitable method and means which are known in the art. Conditions such as borehole diameter, borehole casing, depth of penetration, etc., are those suitable for conventional fracturing and subsequent injection and/or production of fluid. Depending upon the thickness and nature of the lignite seam, the boreholes can be spaced from about 5 to 75, generally from about 10 to 50 meters apart. Closer spacings can be used for thicker seams.

The lignite seam is fractured using conventional methods and apparatus. For example, the seam can be fractured hydraulically by pumping a thickened aqueous fluid into the boreholes at high pressure. Alternatively, the seam can be fractured with the aid of explosives.

In one embodiment, after the lignite seam has been fractured, the wells are re-entered and arranged into a pattern of injection wells and production wells. Any conventional pattern such as a series of alternating injection and production wells can be used. The wells can be prepared for operations such as by enlarging the zone at the base of each well by conventional means such as by a water jet.

The aqueous solution of dispersing agent is passed into each injection well at a rate and at a pressure which is high enough to form and to propel a lignite slurry but low enough to avoid excessive losses of the dispersing agent to the surrounding strata. These rates and pressures will vary with the depth and nature of the lignite seams and with the spacing of the wells. Generally the pressure will be in the range of from about 50 to about 3000 psig, more usually 100 to 500 psig. The aqueous solution of dispersing agent can be injected at any convenient temperature in the range of from about 32° to about 210° F.

The pulsation of the solution entering the lignite formation, in some cases, will permit employing it at a lower overall pressure because the vibrations imparted to the lignite will aid in loosening it as well as to suspend it in the carrier fluid or solution.

The now preferred dispersing agents which are applicable for use in the process of the present invention are the soluble sodium, potassium, and ammonium orthophosphates, pyrophosphates, and triphosphates. Some specific examples of these are ammonium monohydrogen phosphate, potassium monohydrogen phosphate, potassium dihydrogen phosphate, tripotassium phosphate, sodium ammonium hydrogen phosphate, sodium monohydrogen phosphate, sodium dihydrogen phosphate, sodium dihydrogen pyrophosphate, tetrapotassium pyrophosphate, tetrasodium pyrophosphate, pentasodium triphosphate, crysyl diphenyl phosphate, tributyl phosphate, diethylchlorophosphate, tris(2-chloropropyl) phosphate, tris(2,3-dibromopropyl) phosphate, tris(dichloropropyl) phosphate, tris(2-chloroethyl) phosphate, piperazenephosphate, and the like, and mixtures thereof. Other dispersants, surfactants, or materials aiding in the raising from the formation of the lignite as a movable mass, can be used as such or in combination with the phosphate.

The concentration of the phosphate or dispersing agent in water usually will be in the range of from about 0.05 to about 2.5 wt. %. Generally, also, the pH of the solution should be in the range of from about 7.0 to about 13.5 and can be adjusted into this range by the addition of small amounts of sodium hydroxide or similar strong base, or hydrochloric acid or similar strong acid. The optimum concentration for each desired dispersant or additive can be determined by routine test.

The lignite slurry is produced from the production wells using conventional methods and means such as those used for pumping and transporting aqueous slurry. Except for the fact that the fluid being produced is an aqueous slurry, downhole and uphole equipment similar to that used for secondary oil production can be used.

About 2–100 pounds of phosphate dispersing agent is used per ton of lignite recovered. About 1–10 tons of water is used per ton of lignite recovered.

The lignite is separated from the aqueous solution of dispersing agent by using any convenient means such as settling, filtration, centrifugation, and the like. The separation can be carried out either continuously or batch wise. The separated lignite can be water-washed if desired to remove and recover more of the phosphate dispersing agent.

The aqueous phosphate solution separated from the lignite is recycled to the formation by means of the injection wells. Before reinjection the solution can be fortified with make-up amounts of phosphate and/or water to bring the solution to the desired volume and concentration. Recovery of phosphate for recycle can be from about 80 to about 95 percent per pass.

To further illustrate the process of the present invention, the following calculated example is provided.

A lignite seam 1000 feet deep and 15 feet thick is penetrated by an alternating sequence of injection wells and production wells spaced 15 meters apart. The seam, previously fractured, is injected with a 0.15 wt. % aqueous solution of tetrasodium pyrophosphate.

Referring now to the FIGURE which illustrates a simplified form of the invention, make-up tetrasodium pyrophosphate, at a rate of 1 pound per hour, is blended and dissolved in 665 pounds per hour of make-up water, 9 pounds per hour of recycled phosphate dissolved in 6000 pounds per hour are recycled. The phosphate solution, containing 0.15 wt. % tetrasodium pyrophospate, is injected by means of a 40 hp pump into the injection well and into the fractured lignite seam. The phosphate solution, in this example, enters the injection well at a temperature of 78° F. and a pH of 9.

A slurry of 8000 pounds per hour of lignite-phosphate solution is pumped by a 4 hp pump through and from the production well into a dewatering zone in which filtering and washing of the slurry is effected 2000 pounds per hour lignite, wet with about 50 wt. % water, are recovered.

The energy requirement to produce the lignite according to the method of the present invention, including the boring of wells, the fracturing of formation, injection of dispersing agent, and the pumping of slurry to the surface is about 5% of the energy content of the recovered lignite.

Referring now to the drawing in which there is shown an embodiment of the invention, water introduced at 1 together with a dispersant or surfactant introduced at 2 is pumped by 3 down through borehole or well 4 established in the formation at 5. The production thus formed is pumped through prefractured lignite stratum 6 wherein a lignite suspension is formed. The suspension passes upwardly through well 7 aided by pump 8. The suspension is dewatered at 9. Lignite is removed at 10 and solution or water, as the case may be, is passed by 11 to the inlet of pump 3 for re-use.

Reasonable variation and modification are possible within the scope of the foregoing disclosure, the drawing, and the appended claims to the invention the essence of which is that lignite is in situ suspended in a production fluid which is injected into an underground formation of the lignite is a manner, as described, to form a suspension of lignite in the fluid whereupon the fluid is produced and lignite recovered therefrom at the surface; a fluid from which lignite has been substantially removed being re-usable to recover more lignite.

I claim:

1. A method for recovering lignite from an underground formation which comprises passing a production fluid into and through said formation to form a recoverable suspension of lignite; wherein said production fluid contains a phosphate dispersing agent and wherein the concentration of said phosphate dispersing agent, based upon total weight of said production fluid, is less than 2.0 weight percent and greater than about 0.05 weight percent.

2. A method in accordance with claim 1 wherein said production fluid is pulsatingly injected into said formation.

3. A method in accordance with claim 1 or 2 wherein said phosphate dispersing agent is selected from the group consisting of soluble sodium, potassium and ammonium orthophosphates, pyrophosphates and triphosphates.

4. A method in accordance with claim 1 or 2 wherein at least one injection well and at least one production well are employed.

* * * * *